US012128990B1

(12) United States Patent
Berman et al.

(10) Patent No.: US 12,128,990 B1
(45) Date of Patent: Oct. 29, 2024

(54) WINDSHIELD SYSTEM FOR BOATS

(71) Applicant: Chris-Craft Corporation, Sarasota, FL (US)

(72) Inventors: Ronald M. Berman, Palmetto, FL (US); Christopher Collier, Myakka City, FL (US); Carlo Galeazzi, Rome (IT)

(73) Assignee: Chris-Craft Corporation, Sarasota, FL (US)

( * ) Notice: Subject to any disclaimer, the term of this patent is extended or adjusted under 35 U.S.C. 154(b) by 436 days.

(21) Appl. No.: 17/673,875

(22) Filed: Feb. 17, 2022

Related U.S. Application Data

(60) Provisional application No. 63/150,706, filed on Feb. 18, 2021.

(51) Int. Cl.
*B63B 19/02* (2006.01)
*B63B 17/02* (2006.01)

(52) U.S. Cl.
CPC ..... *B63B 19/02* (2013.01); *B63B 17/02* (2013.01)

(58) Field of Classification Search
CPC ..... B63B 17/00; B63B 17/02; B63B 19/00; B63B 19/02
USPC ..... 114/361
See application file for complete search history.

(56) References Cited

U.S. PATENT DOCUMENTS

| | | | | |
|---|---|---|---|---|
| 3,134,122 | A | 5/1964 | Charvat | |
| 3,438,073 | A * | 4/1969 | Brown | B63B 19/02 114/361 |
| 6,131,340 | A | 10/2000 | Clark et al. | |
| 9,688,363 | B1 | 6/2017 | Marshall et al. | |
| 2005/0288582 | A1 | 12/2005 | Yu et al. | |
| 2017/0349244 | A1 | 12/2017 | Kalil | |

OTHER PUBLICATIONS

ABYC H-1, "Field of Vision From the Helm Position" (Jul. 2019) (published by the American Boat & Yacht Council, Inc.

* cited by examiner

*Primary Examiner* — Lars A Olson
(74) *Attorney, Agent, or Firm* — Mueting Raasch Group

(57) ABSTRACT

Windshield systems for boats and methods of using the same are described herein. The windshield systems described herein include a pass-thru section that rotates between open and closed positions about an axis located proximate the top end of the pass-thru section.

22 Claims, 6 Drawing Sheets

WINDSHIELD SYSTEM FOR BOATS

RELATED APPLICATION

This application claims the benefit under 35 U.S.C. Section 119 of U.S. Provisional Patent Application Ser. No. 63/150,706 entitled "WINDSHIELD SYSTEM FOR BOATS" filed on Feb. 18, 2021, which is incorporated herein by reference in its entirety.

FIELD

Windshield systems for boats and methods of using the same are described herein.

BACKGROUND

In boats, such as boats commonly referred to as bow riders or dual console boats, it is desirable to provide protection from wind and precipitation for occupants located aft of the windshield. On such boats, it is typical to have a windshield that opens to allow for easy access to the bow or forward areas of the boat when opened, while still providing protection for occupants located aft of the windshield when the windshield is closed.

On boats with larger windshields, the portion of the windshield that opens can be heavy and hard to handle. In addition, when open, the movable panels commonly lay over one of the fixed portions of the windshield, potentially obstructing visibility for occupants located behind the opened panel.

SUMMARY

Windshield systems for boats and methods of using the same are described herein. The windshield systems described herein include a pass-thru section that rotates about an axis located proximate the top end of the pass-thru section such that, when opened and in the open position, the bottom end of the pass-thru section may, for example, be located above the otherwise unobstructed line of sight of the occupants located aft of the windshield.

Rotating the pass-thru section about an axis located proximate the top end of the pass-thru section avoids the disadvantages associated with hinged or sliding pass-thru windshield sections that are positioned over an adjacent (typically port) side of the windshield system on a boat.

Rotating the pass-thru system about an axis located proximate the top end of the pass-thru section also provides the opportunity to position the components used to rotate the pass-thru section above the pass-thru section when the pass-thru section is in the open position which provides the opportunity to position the components out of view of a majority of the occupants of the boat.

In one or more embodiments, rotating the pass-thru system as described herein such that the components used to rotate the pass-thru section are located above the opened pass-thru section also offers an opportunity to automate the opening and closing of the pass-thru section using one or more driven actuators (e.g., electric motors, hydraulic actuators, pneumatic actuators, spring-powered actuators, etc.). As a result, opening and closing of the pass-thru section may be accomplished by any occupant regardless of the size and weight of the pass-thru section. Even in pass-thru sections that are not moved by driven actuators, opening and closing of the pass-thru section can be assisted by, e.g., one or more assist mechanisms (e.g., gas powered struts, springs (e.g., torsion springs), etc.) to reduce the forces required to open and close the pass-thru sections (such assist mechanisms can also be used in combination with one or more driven actuators to reduce the power requirements for the driven actuators).

In a first aspect, one or more embodiments of a windshield system for a boat as described includes: a windshield comprising a port section, a starboard section, and a pass-thru section, wherein the pass-thru section is located between the port section and the starboard section, wherein the windshield separates a bow area from a cockpit area located aft of the bow area; a roof located above the windshield, wherein the roof extends forward of the windshield to a leading edge located between the windshield and the bow; wherein the pass-thru section is configured to move between a closed position and an open position, wherein the pass-thru section is aligned with the port section and the starboard section to form a windshield that extends continuously from a port edge of the port section to a starboard edge of the starboard section when the pass-thru section is in the closed position, and wherein the pass-thru section is generally aligned with the roof above the bow area when the pass-thru section is in the open position such that passage through the windshield between the port section and the starboard section is allowed; wherein the pass-thru section rotates about an axis when moving between the closed position and the open position, wherein the axis is located proximate a top end of the pass-thru section, wherein the top end of the pass-thru section is located proximate the roof when the pass-thru section is in both the closed position and the open position; wherein the pass-thru section comprises a bottom end distal from the top end, wherein the bottom end of the pass-thru section is located proximate the roof when the pass-thru section is in the open position, and wherein the bottom end of the pass-thru section is located proximate a bottom end of each of the port section and the starboard section of the windshield when the pass-thru section is in the closed position; and wherein the windshield system comprises a latch configured to retain the bottom end of the pass-thru section proximate the roof when the pass-thru section is in the open position.

In one or more embodiments of a windshield system as described herein, the latch comprises a latch bolt configured to move between an extended position and a retracted position, wherein the latch bolt engages with a latch receiver to retain the bottom end of the pass-thru section proximate the roof. In one or more embodiments, the latch comprises a motorized latch bolt configured to engage the latch receiver when the latch bolt is located proximate the latch receiver. In one or more embodiments, the latch bolt is attached to the pass-thru section and the latch receiver is attached to the roof. In one or more embodiments, the latch bolt is attached to the roof and the latch receiver is attached to the pass-thru section.

In one or more embodiments of a windshield system as described herein, the latch is located proximate the bottom end of the pass-thru section.

In one or more embodiments of a windshield system as described herein, the windshield system comprises an actuator configured to at least partially support a mass of the pass-thru section when the pass-thru section is rotating from the closed position to the open position. In one or more embodiments, the actuator comprises a motor configured to rotate the pass-thru section between the closed position and the open position. In one or more embodiments, the actuator comprises a gas-powered strut. In one or more embodiments, the actuator is located above the pass-thru section when the pass-thru section is in the open position.

In a second aspect, one or more embodiments of a windshield system for a boat as described herein includes: a windshield comprising a port section, a starboard section, and a pass-thru section, wherein the pass-thru section is located between the port section and the starboard section, wherein the windshield separates a bow area from a cockpit area located aft of the bow area; a roof located above the windshield, wherein the roof extends forward of the windshield to a leading edge located between the windshield and the bow; wherein the pass-thru section is configured to move between a closed position and an open position, wherein the pass-thru section is aligned with the port section and the starboard section to form a windshield that extends continuously from a port edge of the port section to a starboard edge of the starboard section when the pass-thru section is in the closed position, and wherein the pass-thru section is aligned with the roof above the bow area when the pass-thru section is in the open position such that passage through the windshield between the port section and the starboard section is allowed; wherein the pass-thru section rotates about an axis when moving between the closed position and the open position, wherein the axis is located proximate a top end of the pass-thru section, wherein the top end of the pass-thru section is located proximate the roof when the pass-thru section is in both the closed position and the open position; wherein the pass-thru section comprises a bottom end distal from the top end, wherein the bottom end of the pass-thru section is located proximate the roof when the pass-thru section is in the open position, and wherein the bottom end of the pass-thru section is located proximate a bottom end of each of the port section and the starboard section of the windshield when the pass-thru section is in the closed position; and wherein the bottom end of the pass-thru section is located at or above the leading edge of the roof when the pass-thru section is in the open position.

In one or more embodiments of a windshield system as described herein, the bottom end of the pass-thru section is located at or above the top end of the pass-thru section when the pass-thru section is in the open position.

In one or more embodiments of a windshield system as described herein, the windshield system comprises a latch configured to retain the bottom end of the pass-thru section proximate the roof when the pass-thru section is in the open position.

In one or more embodiments of a windshield system as described herein, the latch comprises a latch bolt configured to move between an extended position and a retracted position, wherein the latch bolt engages with a latch receiver to retain the bottom end of the pass-thru section proximate the roof. In one or more embodiments, the latch bolt comprises a motorized latch bolt configured to engage the latch receiver when the latch bolt is located proximate the latch receiver. In one or more embodiments, the latch bolt is attached to the pass-thru section and the latch receiver is attached to the roof. In one or more embodiments, the latch bolt is attached to the roof and the latch receiver is attached to the pass-thru section.

In one or more embodiments of a windshield system including a latch as described herein, the latch is located proximate the bottom end of the pass-thru section.

In one or more embodiments of a windshield system as described herein, the windshield system comprises an actuator configured to at least partially support a mass of the pass-thru section when the pass-thru section is rotating from the closed position to the open position. In one or more embodiments, the actuator comprises a motor configured to rotate the pass-thru section between the closed position and the open position. In one or more embodiments, the actuator comprises a gas-powered strut. In one or more embodiments, the actuator is located above the pass-thru section when the pass-thru section is in the open position.

In a third aspect, one or more embodiments of windshield system for a boat as described herein includes: a windshield comprising a port section, a starboard section, and a pass-thru section, wherein the pass-thru section is located between the port section and the starboard section, wherein the windshield separates a bow area from a cockpit area located aft of the bow area; a roof located above the windshield, wherein the roof extends forward of the windshield to a leading edge located between the windshield and the bow; wherein the pass-thru section is configured to move between a closed position and an open position, wherein the pass-thru section is aligned with the port section and the starboard section to form a windshield that extends continuously from a port edge of the port section to a starboard edge of the starboard section when the pass-thru section is in the closed position, and wherein the pass-thru section is aligned with the roof above the bow area when the pass-thru section is in the open position such that passage through the windshield between the port section and the starboard section is allowed; wherein the pass-thru section rotates about an axis when moving between the closed position and the open position, wherein the axis is located proximate a top end of the pass-thru section, wherein the top end of the pass-thru section is located proximate the roof when the pass-thru section is in both the closed position and the open position; wherein the pass-thru section comprises a bottom end distal from the top end, wherein the bottom end of the pass-thru section is located proximate the roof when the pass-thru section is in the open position, and wherein the bottom end of the pass-thru section is located proximate a bottom end of each of the port section and the starboard section of the windshield when the pass-thru section is in the closed position; and wherein the bottom end of the pass-thru section is located at or above the top end of the pass-thru section when the pass-thru section is in the open position.

If used herein, the term "substantially" has the same meaning as "significantly," and can be understood to modify the term that follows by at least about 75%, at least about 90%, at least about 95%, or at least about 98%. The term "not substantially" as used here has the same meaning as "not significantly," and can be understood to have the inverse meaning of "substantially," i.e., modifying the term that follows by not more than 25%, not more than 10%, not more than 5%, or not more than 2%.

Numeric values used herein include normal variations in measurements as expected by persons skilled in the art and should be understood to have the same meaning as "approximately" and to cover a typical margin of error, such as ±5% of the stated value.

Terms such as "a," "an," and "the" are not intended to refer to only a singular entity but include the general class of which a specific example may be used for illustration.

The terms "a," "an," and "the" are used interchangeably with the term "at least one." The phrases "at least one of" and "comprises at least one of" followed by a list refers to any one of the items in the list and any combination of two or more items in the list.

As used here, the term "or" is generally employed in its usual sense including "and/or" unless the content clearly dictates otherwise. The term "and/or" means one or all of the listed elements or a combination of any two or more of the listed elements.

As used herein, positional terms such as "above," "below," "forward," "aft," etc. refer to the position of a component, feature, etc. with respect to other components, features, etc. in a boat in an upright static floating position.

The words "preferred" and "preferably" refer to embodiments that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure, including the claims.

Figure 1:
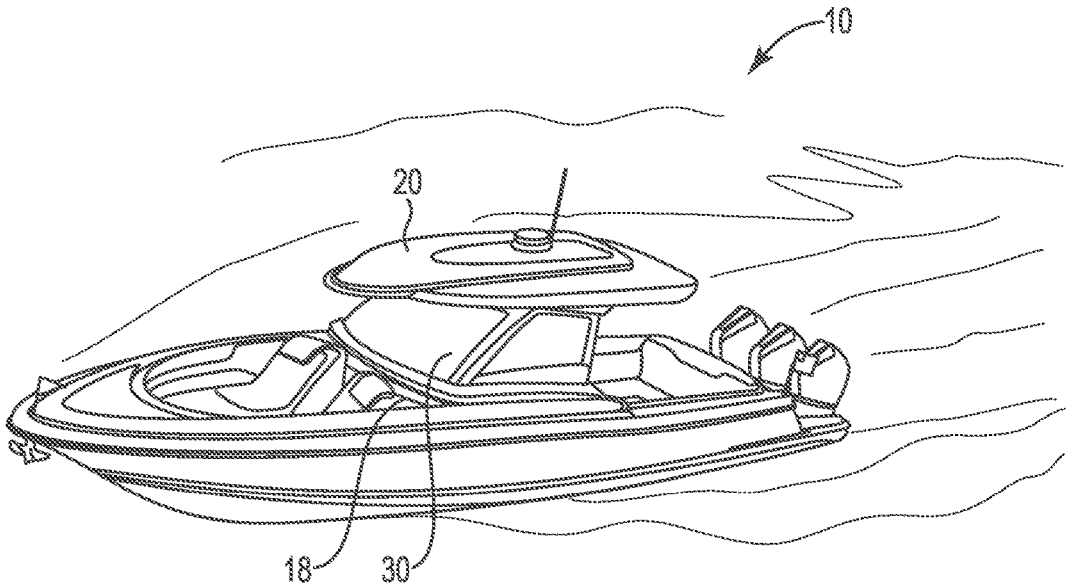
FIG. 1 is a perspective view of one illustrative embodiment of a boat including a windshield system as described herein.

While the above-identified figures (which may or may not be drawn to scale) set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope of this invention.

DESCRIPTION OF ILLUSTRATIVE EMBODIMENTS

Before any illustrative embodiments are described in detail, it is to be understood that the invention is not limited in its application to the details of construction and the arrangement of components set forth in the following description or illustrated in the figures of the drawing. The invention is capable of other embodiments and of being practiced or of being carried out in various ways.

Figure 2:
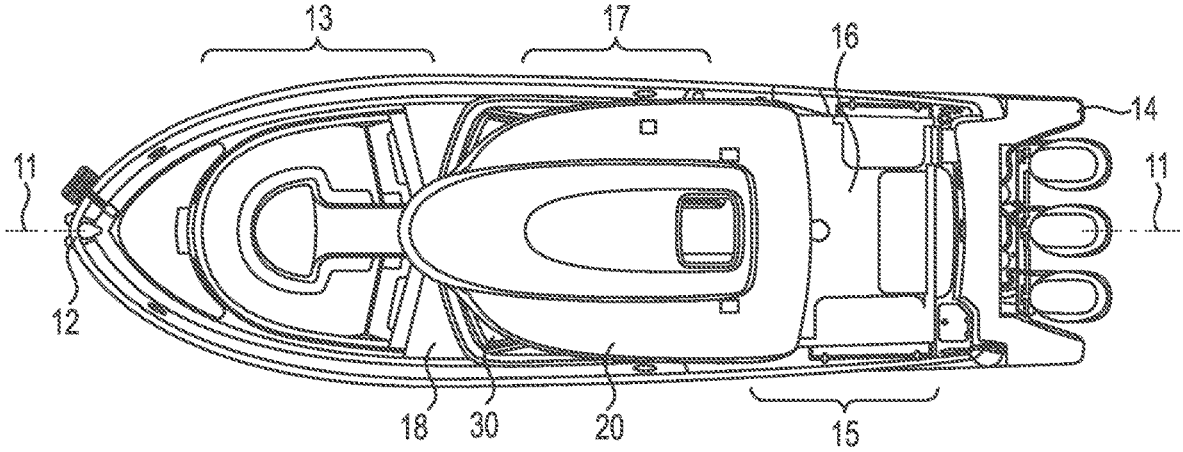
FIG. 2 is a top plan view of the boat of FIG. 1.

One illustrative example of a boat including a windshield system as described herein is depicted in FIGS. 1 and 2. The boat 10 extends from a bow 12 to a stern 14 along a bow-stern axis 11. The boat 10 includes a bow area 13 located forward of a bulkhead 18 and windshield system 30, and aft area 15 located proximate the stern 14 and a cockpit area 17 located between the bow area 13 and the aft area 15. Although not required, the boat 10 would typically include a deck 16 extending from the aft area 15 through the cockpit area 17 and into the bow area 13.

The boat 10 also includes a roof 20 located over the cockpit area 17. The roof 20 may extend partially over the bow area 13 as well as partially over the aft area 16. The roof 20 is preferably in the form of a rigid component (commonly referred to as a hardtop) and may include one or more windows or openings to allow an occupant located in the cockpit area to see through any such windows in the roof 20. Furthermore, other components may be mounted on the roof 20 to assist with navigation and/or communication.

Figure 3:
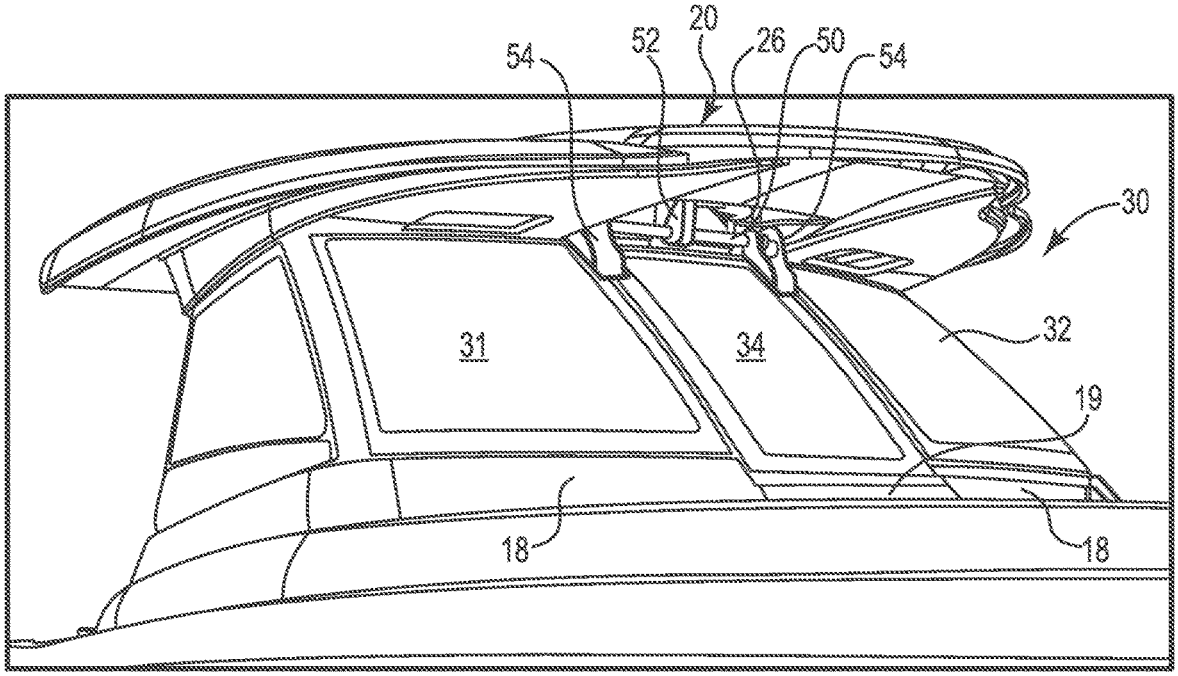
FIG. 3 is a starboard side perspective view of one illustrative embodiment of a windshield system as described herein with the pass-thru section in the closed position.

One illustrative embodiment of a windshield system as described herein is depicted in a starboard side perspective view in FIG. 3. As seen in FIG. 3, the windshield system includes a windshield 30 having a starboard section 31 and a port section 32, with a pass-thru section 34 located between the starboard section 31 and the port section 32. In the depicted embodiment, the windshield 30 also includes a starboard side panel extending aft from the starboard section 31 and, although not seen in FIG. 3, a similar portside panel extending aft from the port section 32. When the pass-thru section 34 is located in its closed position as seen in FIG. 3, the pass-thru section 34 is aligned with the starboard section 31 and the port section 32 to form a windshield 30 that extends continuously from a starboard edge of the starboard section 31 two a port edge of the port section 32.

The windshield 30 is located above the bulkhead 18 that separates the bow area 13 from the cockpit area 17 as described above in connection with FIGS. 1-2. Together, the windshield 30 and the bulkhead 18 may provide protection to occupants located aft of the bulkhead 18 and windshield 30. Bulkhead 18 may include a door 19 located below the pass-thru section 34 that, in one or more illustrative embodiments, slides into the portside of the bulkhead 18 when the pass-thru section 34 of the windshield 30 is in its open position to provide access to the bow area 13 of the boat 10.

Although described in more detail below, components of the system used to raise and lower the pass-thru section 34 between its closed and open positions are also depicted in FIG. 3. Those components include, for example, a shaft 50 supported in brackets 54 and extended collar 52 attached to shaft 50, with the shaft 50 and extended collar 52 being positioned in an actuator cavity 26 provided in the roof 20. In use, a cover is typically provided over the actuator cavity 26 for aesthetics and, at least to some degree, for protection of the components in the actuator cavity 26. That cover is, however, removed in FIG. 3 (as well as in FIGS. 4-5) to expose those components so that they can be described herein.

Although the depicted illustrative embodiment of the windshield system includes only a single pass-thru section 34, one or more alternative embodiments of windshield systems as described herein may include multiple pass-thru sections (each of which may be separately hinged for independent rotation). In still other alternative embodiments, any one (or more) pass-thru sections of the windshield systems described herein may be removable if so desired by an occupant.

Figure 4:
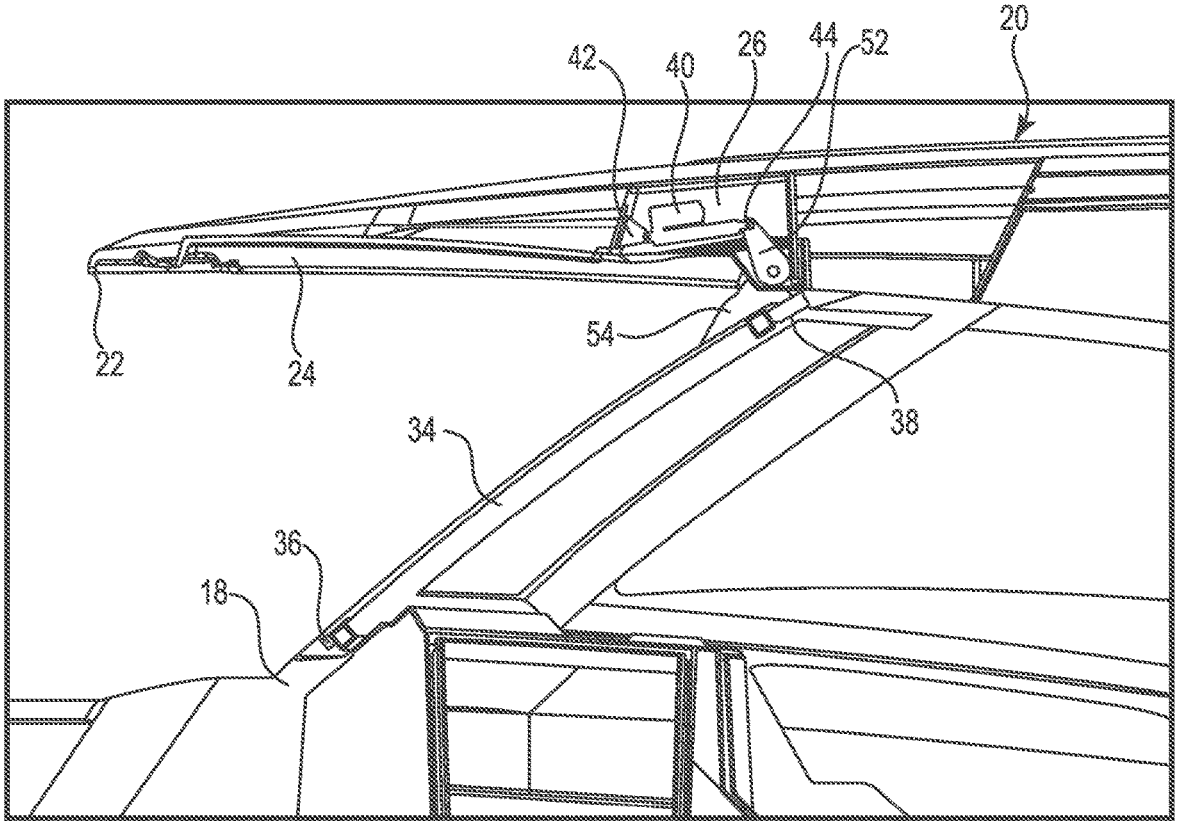
FIG. 4 is a cross-sectional view of the windshield system of FIG. 3 taken in a vertical plane aligned with the bow-stern axis seen in FIG. 2.

FIG. 4 is a cross-sectional view of the windshield system of FIG. 3 taken in a vertical plane extending along the bow-stern axis 11. As seen in FIG. 4, the pass-thru section 34 includes a bottom end 36 and a top end 38, with the bottom end 36 being located distal from the top end 38. With the pass-thru section 34 being in its closed position, the bottom end 36 of the pass-thru section 34 is located proximate the bulkhead 18.

Another feature of the illustrative embodiment of the windshield system described herein is that roof 20 includes a bow edge 22 located forward of the windshield 30, with the roof 20 including an optional cavity 24 into which pass-thru section 34 moves when in its open position as described herein.

Figure 5:
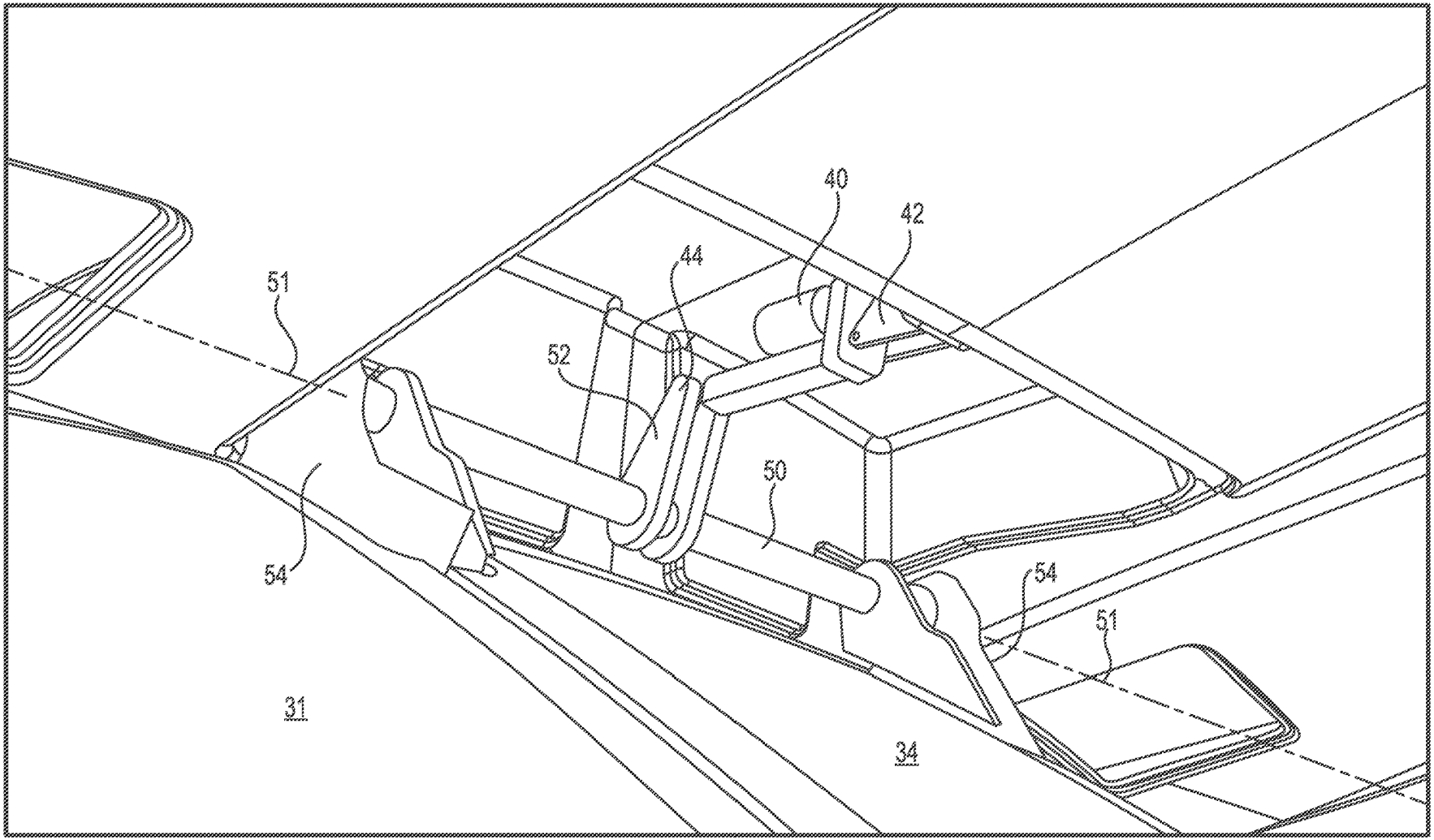
FIG. 5 is an enlarged perspective view of a portion of the windshield system depicted in FIG. 3 depicting one illustrative set of components that may be used to move the pass-thru section between its closed and open positions.

With reference to FIGS. 4-5, roof 20 also includes an actuator cavity 26 in which components used to, in the depicted illustrative embodiment, actively rotate the pass-thru section 34 from its closed position as seen in FIGS. 3-4 to its open position (as seen in, e.g., FIGS. 6-7 below). The components used to rotate the pass-thru section 34 include, in the depicted illustrative embodiment, and actuator 40 attached to the roof 20 at one end by bracket 42 and at an opposite end 44 attached to the extended collar 52 through which shaft 50 extends. As noted in connection with FIG. 3, shaft 50 is supported by brackets 54 attached to pass-thru section 34. The rotational position of extended collar 52 on shaft 50 is fixed.

As a result, operation of actuator 40 to extend the distance between fixed end at bracket 42 and driven end 44 attached to extended collar 52 causes extended collar 52 and shaft 50 to rotate about rotational axis 51 that, in the depicted illustrative embodiment, extends through shaft 50. That rotation is transferred to the pass-thru section 34 at brackets 54 to raise pass-thru section 34 from its closed position as seen in FIG. 4 to its open position as seen in FIGS. 6-7. In the reverse, operation of actuator 42 reduce the distance between its fixed end at bracket 42 and its driven end 44, results in rotation of the shaft 50 and extended collar 52 in the opposite direction to move the pass-thru section 34 from an open position to the closed position seen in FIGS. 3-5. Adjusting the distance between the rotational axis 51 and the driven end 44 of the actuator 40 by shortening or lengthening the extended collar 52 can, respectively, increase or decrease the force required from the actuator 40 to rotate the pass-thru section 34 to the open position about the rotational axis 51.

In one or more embodiments, the pass-thru sections of windshield systems as described herein may rotate about an axis (when moving between the closed and open positions) that is located proximate the top end 38 of the pass-thru section 34. In the depicted illustrative embodiment, the rotational axis 51 is located above the pass-thru section 34 in the closed position and above the top end 38 of the pass-thru section 34 when the pass-thru section 34 is also in the open position. Although not required, the rotational axis 51 of the depicted illustrative embodiment may also be described as being located aft of the top end 38 of the pass-thru section 34 when the pass-thru section 34 is in the open position (see, e.g., FIG. 7). In one or more alternative embodiments, the rotational axis 51 may be located above the bottom end 38 of the pass-thru section 34 but also forward of the top end 38 of the pass-thru section 34 when the pass-thru section 34 is in the open position.

Although the rotational axis 51 extends through the shaft 50 in the depicted illustrative embodiment, in one or more alternative embodiments, the axis of rotation about which the pass-thru section 34 rotates may not be co-located with a central axis of the shaft 50. For example, the actuator(s) used to rotate the pass-thru section 34 may be operably connected to the pass-thru section 34 through a linkage in which the rotational axis 51 is not located within a shaft used to transfer motion of the actuator(s) into rotation of the pass-thru section 34. In one or more embodiments (such as the depicted illustrative embodiment), the pass-thru sections of windshield systems as described herein may move in purely rotational motion when moving between the open and closed positions (i.e., the pass-thru section and/or the axis of rotation about which the pass-thru section rotates move only in rotation about an axis of rotation that is fixed with respect to the boat).

Actuator 40 may take any suitable form including, but not limited to, electric systems (including, e.g., one or more electric motors, gears, lead screws, etc.), hydraulic systems, pneumatic systems, etc. Although only one driven actuator 40 is depicted in connection with the illustrative embodiment, alternative embodiments may include two or more driven actuators. In still other alternative embodiments, one or more assist mechanisms (e.g., gas powered struts, springs (e.g., torsion springs), etc.) may be provided to reduce the power requirements for any driven actuators. Moreover, the other components of the illustrative system used to raise and lower the pass-thru section may also be replaced by other suitable components so long as the resulting system has the ability to rotate the pass-thru section about an axis located proximate its top end 38 as described herein.

Figure 6:
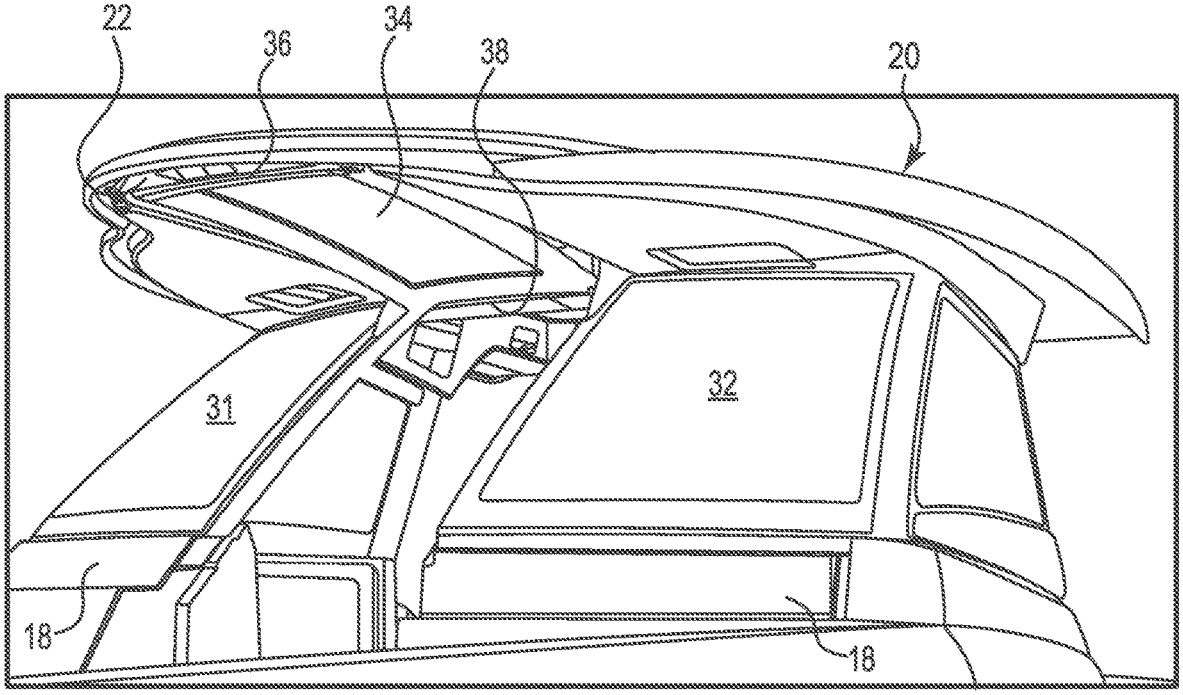
FIG. 6 is a portside perspective view of the windshield system of FIG. 3 with the pass-thru section being located in the open position.
Figure 7:
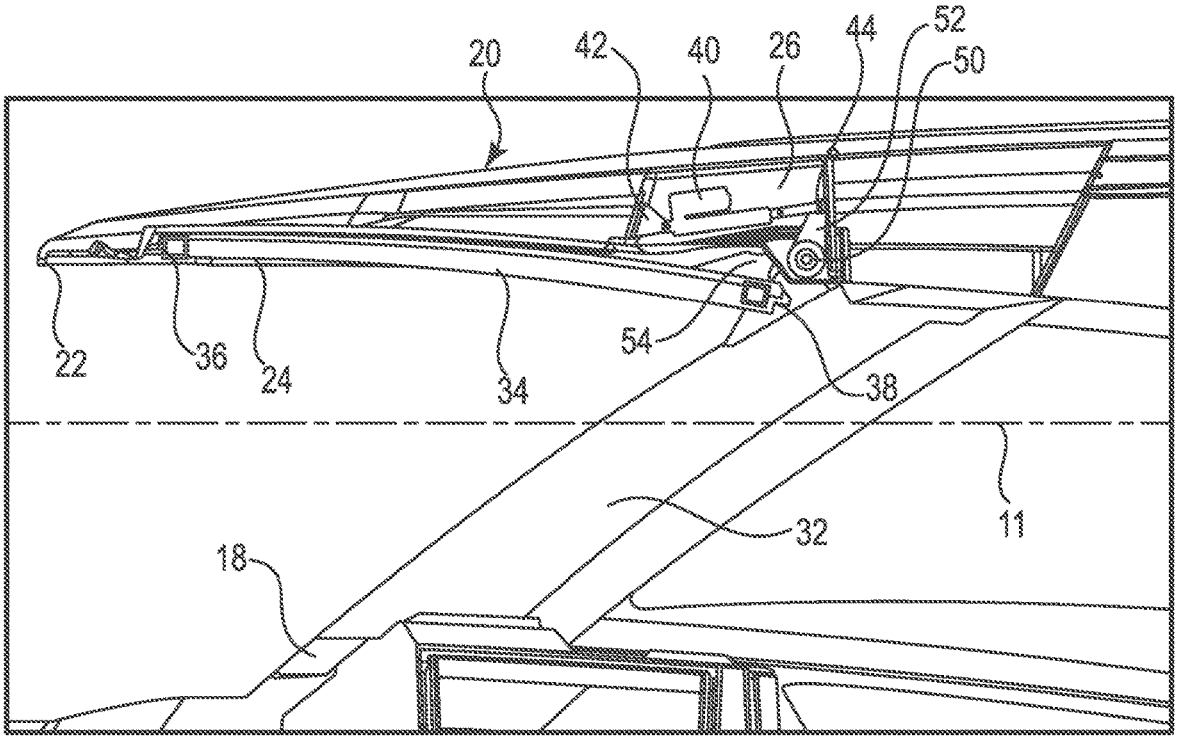
FIG. 7 is a cross-sectional view of the windshield system of FIG. 6 taken in a vertical plane aligned with the bow-stern axis.
Figure 8:
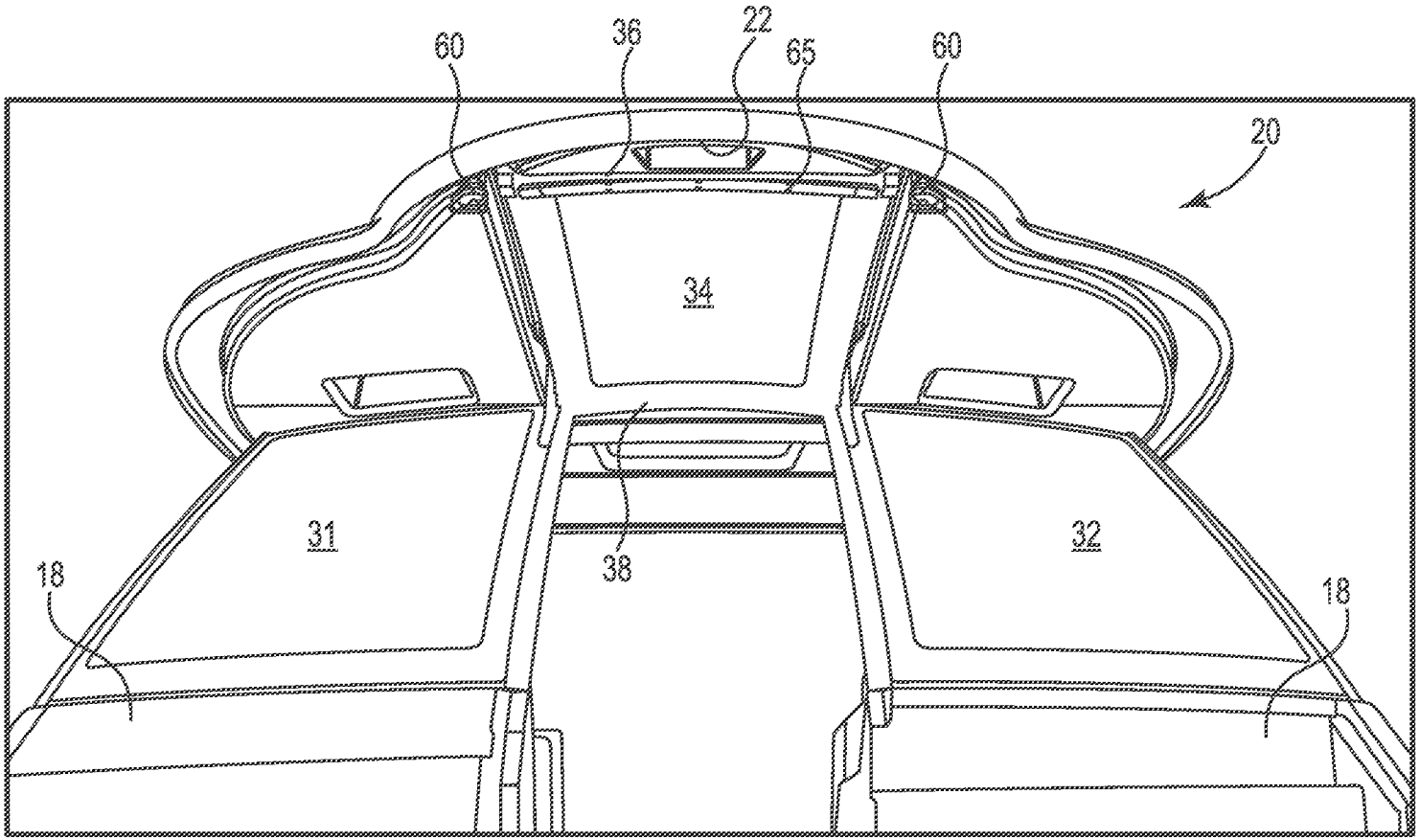
FIG. 8 is a perspective view of the windshield system of FIG. 6 from the bow of the boat.

In each of FIGS. 6-8, the pass-thru section 34 is depicted in its open position in which the bottom end 36 of the pass-thru section is located proximate the roof 20 (with the bottom end 36 of the pass-thru section 34 being located proximate the bottom ends of the starboard section 31 and port section 32 of the windshield 30 when the pass-thru section is in the closed position as seen in, e.g., FIGS. 3-4). The pass-thru section 34 may be described as being generally aligned with the roof 20 above the bow area 13 when the pass-thru section 34 is in the open position such that passage through the windshield 30 between the starboard section 31 and the port section 32 is allowed.

As seen in FIG. 7, the actuator 40 used to move the pass-thru section 34 as described herein is located in an extended configuration as compared to the actuator 40 as seen in FIG. 4. In extended configuration seen in FIG. 7, the fixed end of the actuator 40 attached to bracket 42 and the opposite end 44 attached to extended collar 52 are located farther apart as compared to the retracted configuration of the actuator 40 as seen in FIG. 4.

Another feature of the windshield systems described herein depicted in FIG. 7 is the relative positioning of the pass-thru section 34 relative to both itself and to the roof 20. When in the open position as seen in FIG. 7, it may be preferred that the bottom end 36 of the pass-thru section 34 is located at or above the top end 38 of the pass-thru section 34. In many embodiments of the windshield systems described herein, positioning the bottom end 36 of the pass-thru section 34 at or above the top end 38 of the pass-thru section 34 may limit or eliminate any interference from the bottom end 36 of the pass-thru section 34 with the view of occupants located aft of the windshield 30. In addition to being aesthetically pleasing, improvements in sightlines for occupants located aft of the windshield may also improve safety for those occupants by removing a potential obstruction.

Another manner of characterizing the orientation of the pass-thru section 34 when in the open position is to describe the bottom end 36 of the pass-thru section 34 being located at or above the leading edge 22 of the roof 20. Accomplishing that arrangement may be enhanced by providing cavity 24 in the roof 22 to receive at least a portion of the pass-thru section 34 such that the bottom end 36 can be located below the leading edge 22 of the roof 20. Positioning the bottom end 36 of the pass-thru section 34 at or above the leading edge 22 of the roof 20 may, as described above, limit or eliminate any interference from the bottom end 36 of the pass-thru section with the view of occupants located aft of the windshield 30, thereby potentially also improving safety as described herein.

Whether the relative position of the bottom end 36 of the pass-thru section 34 is described with respect to the top end 38 of the pass-thru section 34 or the leading edge 22 of the roof 20, those relative positions may preferably be described with respect to a horizontal line/axis generally aligned with the standing high eye position at the helm of a boat including a windshield system as described herein. The standing high eye position may be established for any boat with reference to ABYC H-1, "FIELD OF VISION FROM THE HELM POSITION" (July 2019) (published by the American Boat & Yacht Council, Inc.

Figure 9:
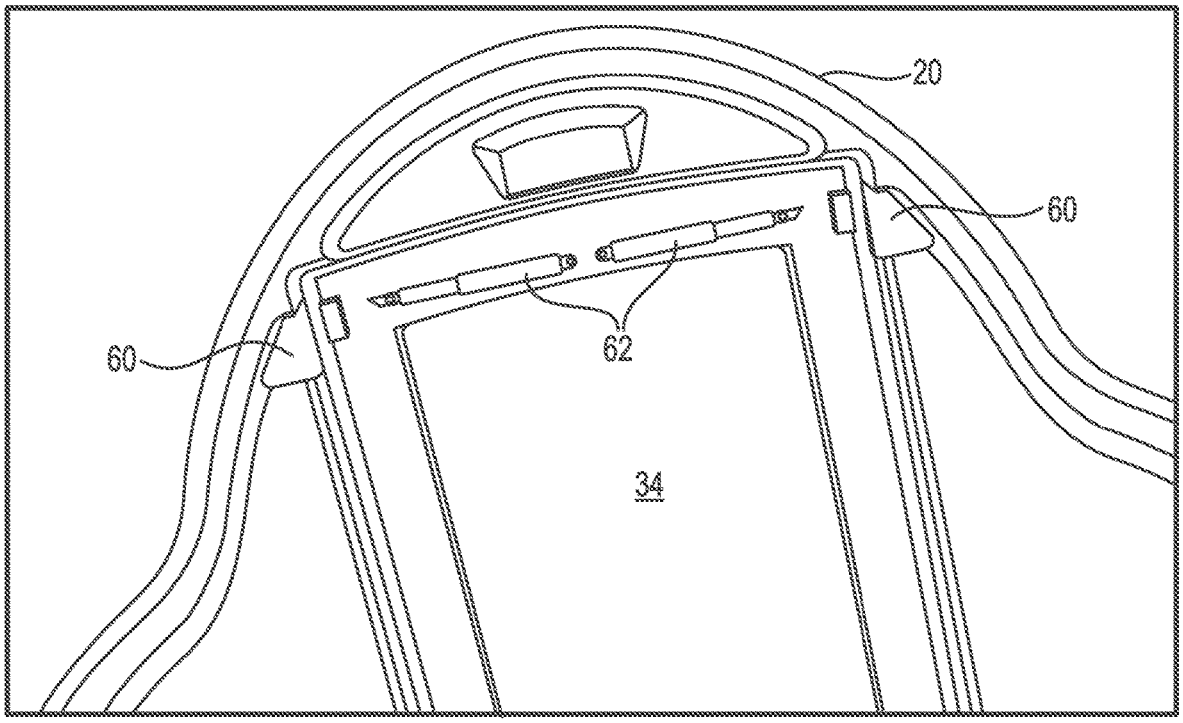
FIG. 9 is a view of the bottom of the roof of the boat, with the pass-thru section located in the open position and actuators of the latch assembly used to retain the pass-thru section in the open position being exposed in this view.
Figure 10:
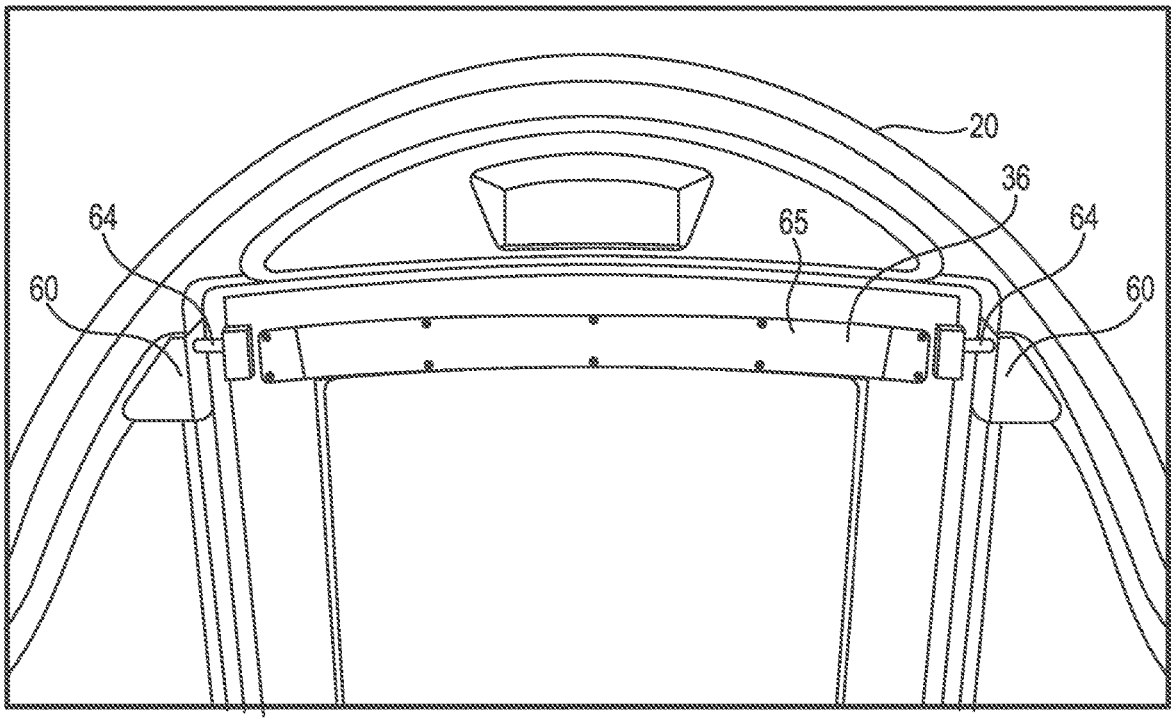
FIG. 10 is a view of the bottom of the roof of the boat, with the pass-thru section located in the open position as seen in FIG. 9 with the latch bolts extended to retain the pass-thru section in the open position.

With reference to FIGS. 8-10, one or more embodiments of a windshield system as described herein may include a latch configured to retain the bottom end 36 of the pass-thru section 34 proximate the roof 20 of the boat 10 when the pass-thru section 34 is in the open position. Components of one illustrative embodiment of a latch are depicted in FIGS. 8-10 and include latch receivers 60 located on the port and starboard sides of the bottom end 36 of the pass-thru section 34. Referring to FIG. 10, latch receivers 60 are configured to receive latch bolts 64 that extend outwardly from the pass-thru section 34 when the pass-thru section 34 is in the open position as seen in FIG. 10. The latch bolts 64 may be described as being configured to move between an extended position as seen in FIG. 10 and a retracted position as seen in FIG. 9. The latch bolts 64 engage with the latch receivers 60 to retain the bottom end 36 of the pass-thru section 34 proximate the roof 20.

With reference to FIGS. 8-10, the latches of the depicted illustrative embodiment are located within the frame that runs along the bottom end 36 of the pass-thru section 34 and are located behind a cover 65 as seen in FIGS. 8 and 10. With the cover removed as seen in FIG. 9, the actuators 62 used to move the latch bolts 64 between their extended and retracted positions are visible. In the depicted embodiment, the actuator 62 are motorized such that after the bottom end 36 of the pass-thru section 34 is located in its open position, the actuators can be operated to move the latch bolts from their retracted position within the frame of the pass-thru section 34 to their extended position in which the latch bolts 64 are received in latch bolt receivers 60 to assist in retaining the pass-thru section 34 in its open position.

Although the depicted actuators 62 are motorized, it should be understood that alternative embodiments of latch systems may move latch bolts using one or more of spring actuators, hydraulic actuators, pneumatic actuators, etc. Those actuators may be manually operated or they may be driven as needed. Further, although the depicted windshield system includes a pair of latches on opposite sides of the pass-thru section 34, one or more alternative embodiments of windshield systems as described herein may include only a single latch. Further, one or more alternative embodiments of windshield systems as described herein may include one or more latches positioned at other locations along the pass-thru section 34, i.e., the latch or latches may be located proximally of the bottom end 36 of the pass-thru section 34. In one or more embodiments, it may be preferred that any latch or latches be positioned closer to the bottom end 36 of the pass-thru section 34 than the top end 38 of the pass-thru section 34 to, e.g., balance the load for supporting the pass-thru section 34 between the latch or latches and the components (e.g., brackets 54, etc.) supporting the pass-thru section 34 proximate the top end 38.

In still further alternative embodiments, it should be noted that the latch receivers may be located on the pass-thru section and the latch bolts and any actuators associated therewith may be attached to the roof 22.

All references and publications cited herein are expressly incorporated herein by reference in their entirety into this disclosure, except to the extent they may directly contradict this disclosure. Although specific illustrative embodiments have been described herein, it will be appreciated by those of ordinary skill in the art that a variety of alternate and/or equivalent implementations can be substituted for the specific embodiments shown and described without departing from the scope of the present disclosure. It should be understood that this disclosure is not intended to be unduly limited by the illustrative embodiments and examples set forth herein and that such examples and embodiments are presented by way of example only with the scope of the disclosure intended to be limited only by the claims.

What is claimed is:

1. A windshield system for a boat, the windshield system comprising:

a windshield comprising a port section, a starboard section, and a pass-thru section, wherein the pass-thru section is located between the port section and the starboard section, wherein the windshield separates a bow area from a cockpit area located aft of the bow area;

a roof located above the windshield, wherein the roof extends forward of the windshield to a leading edge located between the windshield and the bow;

wherein the pass-thru section is configured to move between a closed position and an open position, wherein the pass-thru section is aligned with the port section and the starboard section to form a windshield that extends continuously from a port edge of the port section to a starboard edge of the starboard section when the pass-thru section is in the closed position, and wherein the pass-thru section is generally aligned with the roof above the bow area when the pass-thru section is in the open position such that passage through the windshield between the port section and the starboard section is allowed;

wherein the pass-thru section rotates about an axis when moving between the closed position and the open position, wherein the axis is located proximate a top end of the pass-thru section, wherein the top end of the pass-thru section is located proximate the roof when the pass-thru section is in both the closed position and the open position;

wherein the pass-thru section comprises a bottom end distal from the top end, wherein the bottom end of the pass-thru section is located proximate the roof when the pass-thru section is in the open position, and wherein the bottom end of the pass-thru section is located proximate a bottom end of each of the port section and the starboard section of the windshield when the pass-thru section is in the closed position;

and wherein the windshield system comprises a latch configured to retain the bottom end of the pass-thru section proximate the roof when the pass-thru section is in the open position.

2. A windshield system according to claim 1, wherein the latch comprises a latch bolt configured to move between an extended position and a retracted position, wherein the latch bolt engages with a latch receiver to retain the bottom end of the pass-thru section proximate the roof.

3. A windshield system according to claim 2, wherein the latch comprises a motorized latch bolt configured to engage the latch receiver when the latch bolt is located proximate the latch receiver.

4. A windshield system according to claim 2, wherein the latch bolt is attached to the pass-thru section and the latch receiver is attached to the roof.

5. A windshield system according to claim 2, wherein the latch bolt is attached to the roof and the latch receiver is attached to the pass-thru section.

6. A windshield system according to claim 1, wherein the latch is located proximate the bottom end of the pass-thru section.

7. A windshield system according to claim 1, wherein the windshield system comprises an actuator configured to at least partially support a mass of the pass-thru section when the pass-thru section is rotating from the closed position to the open position.

8. A windshield system according to claim 7, wherein the actuator comprises a motor configured to rotate the pass-thru section between the closed position and the open position.

9. A windshield system according to claim 7, wherein the actuator comprises a gas-powered strut.

10. A windshield system according to claim 7, wherein the actuator is located above the pass-thru section when the pass-thru section is in the open position.

11. A windshield system for a boat, the windshield system comprising:

a windshield comprising a port section, a starboard section, and a pass-thru section, wherein the pass-thru section is located between the port section and the starboard section, wherein the windshield separates a bow area from a cockpit area located aft of the bow area;

a roof located above the windshield, wherein the roof extends forward of the windshield to a leading edge located between the windshield and the bow;

wherein the pass-thru section is configured to move between a closed position and an open position, wherein the pass-thru section is aligned with the port section and the starboard section to form a windshield that extends continuously from a port edge of the port section to a starboard edge of the starboard section when the pass-thru section is in the closed position, and wherein the pass-thru section is aligned with the roof above the bow area when the pass-thru section is in the open position such that passage through the windshield between the port section and the starboard section is allowed;

wherein the pass-thru section rotates about an axis when moving between the closed position and the open position, wherein the axis is located proximate a top end of the pass-thru section, wherein the top end of the pass-thru section is located proximate the roof when the pass-thru section is in both the closed position and the open position;

wherein the pass-thru section comprises a bottom end distal from the top end, wherein the bottom end of the pass-thru section is located proximate the roof when the pass-thru section is in the open position, and wherein the bottom end of the pass-thru section is located proximate a bottom end of each of the port section and the starboard section of the windshield when the pass-thru section is in the closed position;

and wherein the bottom end of the pass-thru section is located at or above the leading edge of the roof when the pass-thru section is in the open position.

12. A windshield system according to claim 11, wherein the bottom end of the pass-thru section is located at or above the top end of the pass-thru section when the pass-thru section is in the open position.

13. A windshield system according to claim 11, wherein the windshield system comprises a latch configured to retain the bottom end of the pass-thru section proximate the roof when the pass-thru section is in the open position.

14. A windshield system according to claim 13, wherein the latch comprises a latch bolt configured to move between an extended position and a retracted position, wherein the latch bolt engages with a latch receiver to retain the bottom end of the pass-thru section proximate the roof.

15. A windshield system according to claim 14, wherein the latch bolt comprises a motorized latch bolt configured to engage the latch receiver when the latch bolt is located proximate the latch receiver.

16. A windshield system according to claim 14, wherein the latch bolt is attached to the pass-thru section and the latch receiver is attached to the roof.

17. A windshield system according to claim 14, wherein the latch bolt is attached to the roof and the latch receiver is attached to the pass-thru section.

18. A windshield system according to claim 13, wherein the latch is located proximate the bottom end of the pass-thru section.

19. A windshield system according to claim 11, wherein the windshield system comprises an actuator configured to at least partially support a mass of the pass-thru section when the pass-thru section is rotating from the closed position to the open position.

20. A windshield system according to claim 19, wherein the actuator comprises a motor configured to rotate the pass-thru section between the closed position and the open position.

21. A windshield system according to claim 19, wherein the actuator comprises a gas-powered strut.

22. A windshield system according to claim 18, wherein the actuator is located above the pass-thru section when the pass-thru section is in the open position.

* * * * *